United States Patent [19]

Crall

[11] 3,980,036

[45] Sept. 14, 1976

[54] ROLLER FURLING ASSEMBLY

[76] Inventor: Donald H. Crall, 1580 Oleander Ave., Chula Vista, Calif. 92011

[22] Filed: Mar. 8, 1976

[21] Appl. No.: 664,521

[52] U.S. Cl. ..... 114/106

[51] Int. Cl.[2] ..... B63H 9/10

[58] Field of Search ..... 114/106, 107, 108, 102, 114/104, 111, 112

[56] References Cited

UNITED STATES PATENTS

| | | | |
|---|---|---|---|
| 3,285,215 | 11/1966 | Potter | 114/106 X |
| 3,485,197 | 12/1969 | Brett | 114/102 |
| 3,789,790 | 2/1974 | Crall | 114/106 |
| 3,802,373 | 4/1974 | Lagerquist | 114/102 X |
| 3,851,609 | 12/1974 | Stearn | 114/105 |
| 3,938,460 | 2/1976 | Wales et al. | 114/106 |

*Primary Examiner*—Trygve M. Blix
*Assistant Examiner*—Gregory W. O'Connor
*Attorney, Agent, or Firm*—Julian Caplan

[57] ABSTRACT

An improvement on U.S. Pat. Nos. 3,789,790 and 3,749,043 employs spool sections which are notched so that they are spliced together over the jib stay rather than having pins in two of the grooves in the sections to join the same end-to-end, thereby freeing two grooves and enabling a second sail and its halyard to be installed. Thus twin jibs may be supported and also furled. The sail is attached to the furling spool by securing slug slides at intervals along the luff of the sail to fit into one groove of the spool. The top of the sail is fixed to a wire rope halyard which runs over a pulley in a crown block fixed to the upper end of the uppermost spool section, then down a groove in the spool. The lower end of the halyard is fixed to a traveler having an apertured ear which extends outside the spool. Several means for tightening the halyard by applying a pull on the ear and several ways of securing the ear in place once it is tightened are disclosed.

11 Claims, 10 Drawing Figures

ROLLER FURLING ASSEMBLY

The present invention relates to a new and improved spool furling assembly incorporating improvements over applicant's U.S. Pat. Nos. 3,789,790 and 3,749,043.

One of the improvements of the present invention is in the means whereby spool sections are joined end-to-end for rotation together. The upper end of each section is fabricated so that one-half of said upper end is cut away whereas the lower end of the adjacent section is cut away in a complementary shape so that the two sections overlap and can be spliced by screws or other fasteners passing transversely through the overlapped portions. This structure eliminates the need of pins previously used to join the sections together; and when these pins are eliminated frees two of the four grooves in the spool sections which were previously used for attachment for the pins so that they can be used for a second sail. Thus, if one sail has become torn, another sail may be installed before the first sail is taken down. Additionally. twin jibs may be attached to the spool. The improved splicing of the spool sections also improves the strength of the joint of the sections and prevents misalignment of adjacent sections.

Another improvement of the present invention is the fact that two sails may be reefed or furled simultaneously if two sails are used.

Another improvement is in the attachment of the sails to the spool. At intervals along the luff of the said slug slides are attached, the outer end of the slug slide having a shape which is substantially complementary to the shape of the slot in the spool. Since the slug slides are of uniform size and accurately dimensioned, the raising and lowering of the sail is facilitated as compared with the previous modification wherein the luff of the sail had to be made of a specified size rope to fit in the groove. By using slug slides the luff can be of any dimension and be either of wire or rope. This saves considerable expense in preparing the sail.

Still another feature of the invention is the use of a wire rope halyard attached to the upper end of the sail which extends over a pulley in a crown block on the top of the spool and then down through a groove in the spool opposite that in which the sail slug slides are installed. The lower end of the halyard has a traveler which slides in the groove and has an ear or fin which extends out through the slot in the groove. The ear or fin is formed with apertures which may be used to tighten or secure the traveler.

Other features include improved means for tightening the halyard. One such means is the use of a halyard tail secured to the fin of the halyard traveler and passing around a pulley near the bottom of the jib stay and thence extending to a winch on the boat where the line may be tightened as needed. As a further improvement, a second pulley may be installed at the traveler fin and a two-to-one mechanical advantage obtained. Another means of tightening the halyard is the use of a block and tackle interconnected between the fin and the drum. Instead of a block and tackle a turnbuckle may be substituted or other means may be employed to tighten the halyard.

Another feature of the invention is the use of means to secure the halyard fin relative to the furling drum once the halyard has been sufficiently tightened. One such means is the use of a chain fastened at its upper end to the fin and at its lower end to a hook or other attachment means on the furling drum. Still another means of attachment is the use of a clamp around the spool which engages the upper edge of the traveler fin and prevents its upward movement.

Other objects of the present invention will become apparent upon reading the following specification and referring to the accompanying drawings in which similar characters of reference represent corresponding parts in each of the several views.

Figures 1, 2, 3, 4:
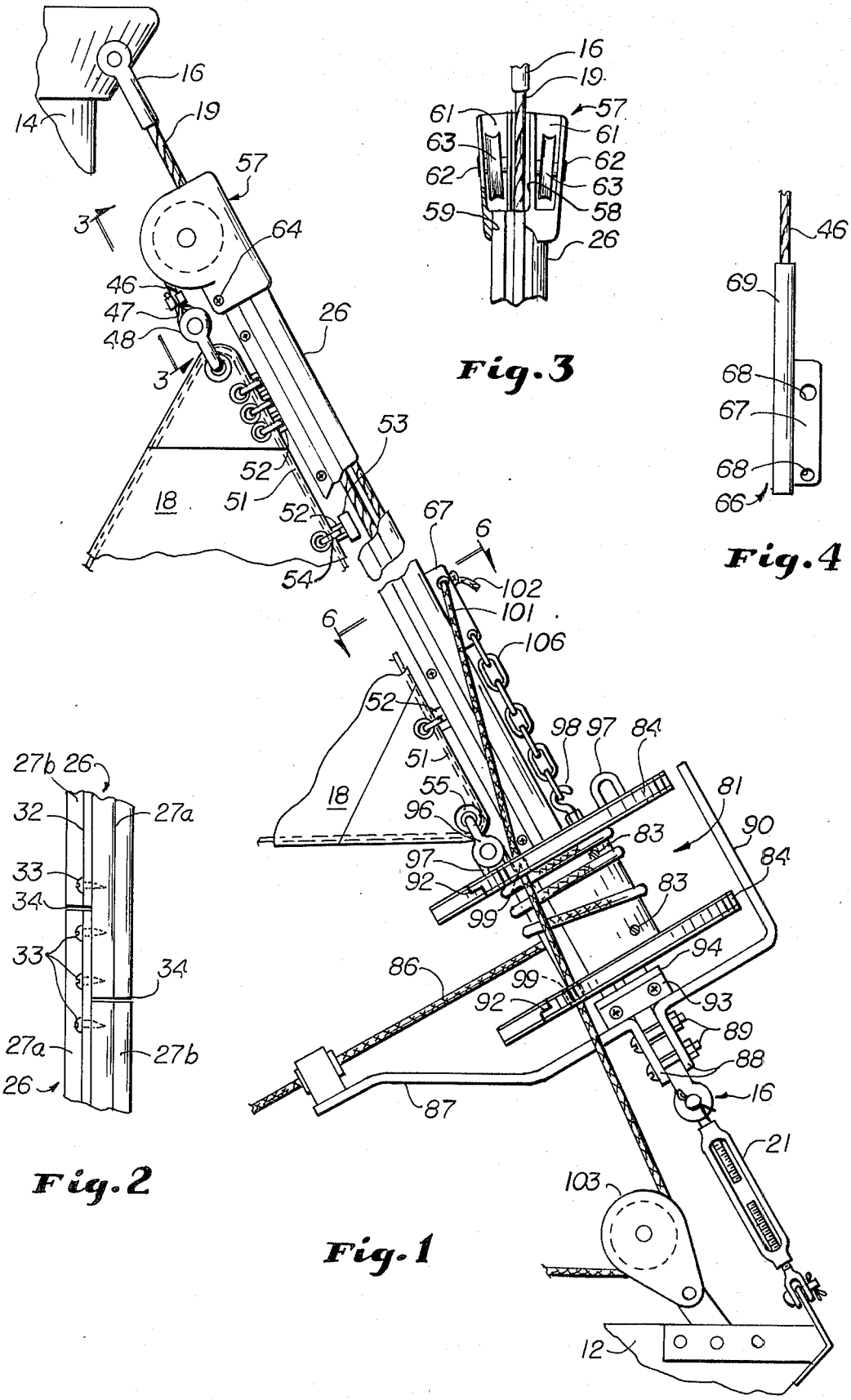
FIG. 1 is a side elevational view of the assembly installed on a jib stay.
FIG. 2 is an enlarged elevational view of a splice between furling spool sections.
FIG. 3 is an enlarged elevational view of the crown block and associated elements viewed from line 3—3 of FIG. 1.
FIG. 4 is an enlarged elevational view of the halyard traveler.
Figure 5:
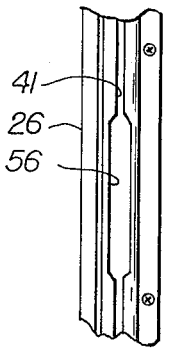
FIG. 5 is an enlarged elevational view of the lower spool section showing a window for insertion of sail slug-slides.

In the accompanying drawings only a portion of a boat is shown, the principal portions being the forward end of hull 12 and mast 14 which projects vertically to a considerable height above the deck. By means of stay fitting 16 or other means the upper end of jib stay 19 which is the principal support for jib sail 18 is attached to the upper end of mast 14. The lower end of stay 19 is attached by means of a tightening turnbuckle 21 to the forward end of the hull 12 in a well known manner. Thus the present invention is adapted to the conventional structure of a sailboat and does not require any constructional change or modification.

A plurality of spool sections 26 each about three feet in length and the number of which depends on the length of the stay 19 is rotatably installed about the stay. The spool sections 26 consist of two identical halves 27*a*, 27*b* which are substantially the same as those shown in U.S. Pat. No. 3,789,790. Thus there is a parting surface 28, 29 on the two halves which are parallel to each other and offset on opposite sides of the center of the combined section 26. The halves on either side have mating tongues 31 and grooves complementary thereto which assist in holding the two halves 27*a*, 27*b* in alignment. In order to secure the two halves in place, screws 33 may be installed in steps 32 in each half. The center 38 of each half is cut away to provide an opening through which stay 19 extends and the size of the stay is sufficiently less than the opening formed by the groove 38 to permit the spool sections to revolve freely.

Each half 27 has a first bore 39 which is connected to the exterior by means of a slot 41. Displaced from bore 39 about 60° is a second bore 42 which is connected to the exterior by slot 43.

A preferred means for joining the sections together is shown in FIG. 2. Although the lengths of the halves 27*a*, 27*b* are equal, they are overlapped so that the top end of section 27*a* is about 3 inches higher than the top end of section 27*b* whereas the reverse relationship applies at the lower end. Thus by overlapping the sections, as best shown in FIG. 2, the half 27*a* of the lower section 26 overlaps the lower end of the right-hand section 27*a* of the upper spool section 26. The screws 33 in step 32 secure the two sections 26 together in a compound splice which is quite strong and assures that the spool sections all rotate together when the spool is used for reefing or furling. Referring to U.S. Pat. No. 3,789,790, the pins 46 of said patent are thus unnecessary.

Sail 18 is formed with a luff 51 in conventional fashion. At intervals of about 6 to 8 inches along the length of luff 51 are slug slides 52 fastened to luff 51 by said twine passing through a grommet in sail 18 immediately inside the luff 51. At the upper end of the luff several sluff slides 52 are attached to accommodate the heavy strain in this area. The bottom-most slug slide is preferably about 6 inches above the tack 55. Other means may be used to attach the slug slides in place. The outer end of each slug slide 52 has an enlargement 53 which is complementary to bores 39 or 42, the shackle portion of the slug slide 52 sliding in the slots 41 or 43. Formed in the lowermost spool section 26 for each slot 41 or 43 is an enlargement or window 56 which is sized sufficiently to accept the enlargement 53 of the slug slide 52. Thus the enlargements 53 of each slug slide are fed through the window 56 into bores 39 or 41 as the sail is being installed. As best shown in FIG. 1, at the upper end of the sail 18 a plurality of slug slies 52 is used as security for the upper end of the sail.

Attached to a grommet in the upper end of jib sail 18 is a wire rope halyard 46. A preferred means of attachment shown in FIG. 1 is by forming an eye 47 in the end of halyard 46 and attaching the same by means of clevis 48 to the grommet in the upper corner of sail 18.

Crown block 57 is fixed to the upper end of the topmost spool section 26. The crown block has a radial slot 58 extending the entire length thereof which permits the installation of the crown block over the stay 19. The lower end of block 57 is formed with a bore 59 which slips over the top end of the uppermost spool section 26. Preferably, the top of the spool section 26 is cut off so that it is even rather than being uneven as shown in FIG. 2. Screws 64 secure the crown block 57 to the top of spool section 26. Openings 61 are formed in the crown block 57 on either side of slot 58 for passage of the halyard 46, it being understood that if two sails 18 are used, two halyards 46 are accommodated by a single block 57. Transverse pins 62 rotatably mounts pulleys 63 over which each halyard passes. Hence by pulling downward on halyard 46 the sail 18 is raised.

As best shown in FIG. 4, on the opposite end of halyard 56 is a traveler 36 consisting of a press sleeve 69 which fits over the end of halyard 46 and is swaged thereto. Extending radially of traveler 66 is a thin ear 67 formed with a plurality of apertures 68 (here shown as two in number). The ear 67 extends out through the slot 41 or 43 in the spool sections 26. In the raising of the sail 18, a halyard tail or other means is passed through one of the apertures 68 and is used to hoist the sail by pulling downwardly on the traveler 66, thus pulling the halyard 46 around the pulley 63.

Figure 7:
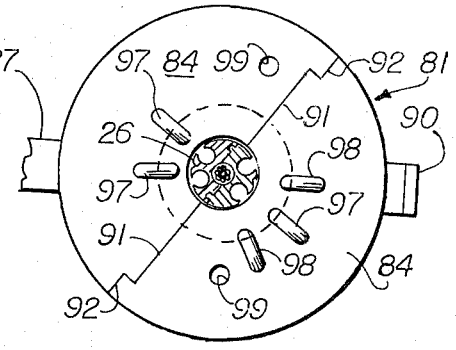
FIG. 7 is a sectional view along line 7—7 of FIG. 1.
Figure 6:
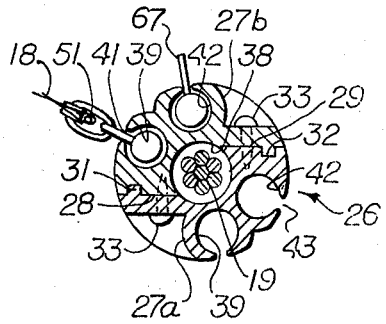
FIG. 6 is a sectional view along line 6—6 of FIG. 1.

Fixed to the lower end of the bottom-most spool section 26 is a furling drum 81 which consists of two semi-cylindrical sections 82 held together by means of transverse screws 83. The sections 82 have bores which are complementary to the exterior of the spool section 26. Hence when the drum 81 is rotated, the lowermost spool section 26 and all other spool sections above it and also the crown block 57 are rotated. Each section 82 has a half circle flange 84 at the top and the bottom. As best shown in FIG. 7, each flange section 84 has a parting line 91 which extends radially out from the bore in the center and has a terminal offset 92 which is formed to overlap with the other half as best shown in FIG. 1.

Furling line 86 passes around the drum sections 82 and out through an eye in fair lead 87 which has legs 88 which overlap the lower end of the stay fitting 16 and are secured thereto against rotation by bolts 89. Guard bracket 90 prevents line 86 from escaping from drum 31. On the stay 19 is a bearing pad 93 and above the bearing pad is a split thrust bearing 94. Thus the weight of the spool sections, furling drum and the tightening of the halyard are supported by the bearing 93 which transmits the weight thereof to the stay fitting 16 and to the turnbuckle 21.

The upper flange 84 is attached to the tack of the sail 18 by means of a clevis 96 passing through tack 55 in the corner of the sail which is in turn fastened to a U-shaped shackle 97 on the top surface of the upper flange 84. Also on the top surface of upper flange 84 are a pair of hooks 98. A hole 99 is formed in on each flange section 84 for passage of a halyard tightening tail 101 which is attached to the traveler ear 67 by a knot 102. A halyard block 103 is connected to the hull 17 adjacent the turnbuckle 21. Thus by pulling on the halyard tail 101 the halyard may be pulled to hoist the sail 18 and also, as hereinafter explained, to tighten same.

Figure 9:
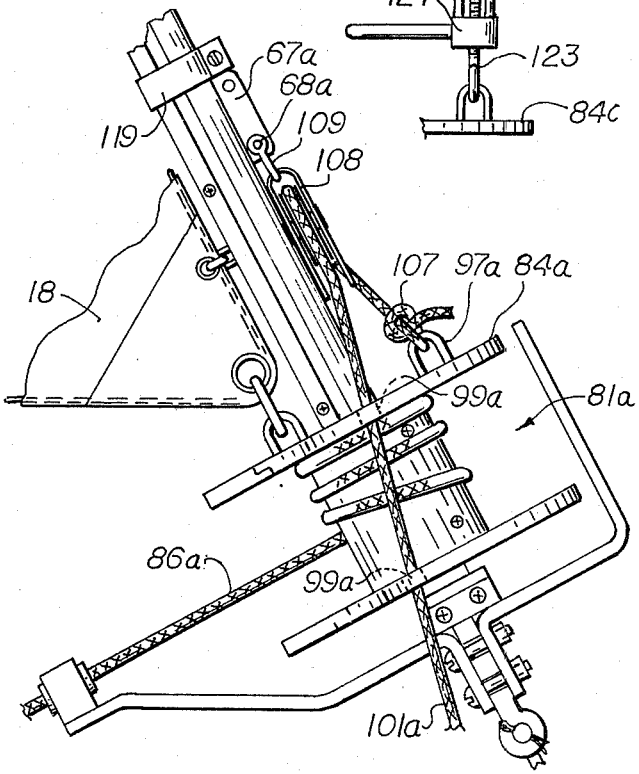
FIG. 9 is a fragmentary elevational view showing a modified halyard tightening means.

An alternate construction is shown in FIG. 9. In this construction a pulley 108 is connected by means of attachment 109 to the lowermost hole in the traveler ear 67. The line 101*a* is connected to one of the shackles 97 on upper flange 84*a* and thence around the pulley 108, through the holes 99 in the flanges 84*a* of the furling drum 81*a* around the pulley 103*a* and thence to a winch on the boat where the line 101*a* may be pulled tight using a winch (not shown).

Once the halyard 19 has been tightened by any of the means heretofore and hereinafter described, it is desirable to secure the same. As shown in FIG. 1, one preferred means is the use of a chain 106 which is fastened to the lowermost hole 68 in ear 67 at its upper end and at its lower end is connected to the hook 98 on the uppermost flange 84. By fitting different lengths of chain 106 in the hook 98, the traveler 66 may be fixed in position relative to the stay 16. Once the chain 106 is attached the line 101 (or 101*a*) and pulley 108 are removed, permitting free rotation of the furling drum 81 for furling purposes.

Another means of securing the halyard in tight condition is shown in FIG. 9. Once the halyard has been tightened, a clamp 119 is placed around the spool section 26 and tightened by means of screw 120. With the clamp 119 fixed in position and resting on the upper edge of the ear 67*a*, the traveler cannot move upward and hence the halyard cannot become loose.

Figure 10:
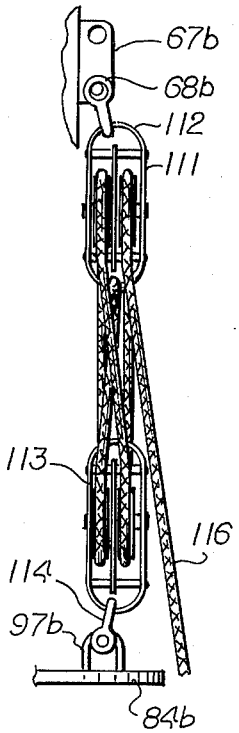
FIG. 10 is an elevational view of still another halyard tightening means.

A substitute for the line 101 is shown in FIG. 10. A block and tackle is used. An upper double block 111 is secured by means of an attachment 112 to a hole 68*b* in the ears 67*b*. Lower double block 113 is secured by attachment 114 to one of the shackles 97*a* on the uppermost drum flange 84*b*. A line 116 is reeved around the two pulley blocks and a considerable mechanical advantage is obtained, the amount whereof depending upon the reeving of the two blocks. To secure the ears 67*b* in place, a chain similar to chain 106 of FIG. 1 may be used or a clamp similar to clamp 119 of FIG. 9 may be used.

Figure 8:
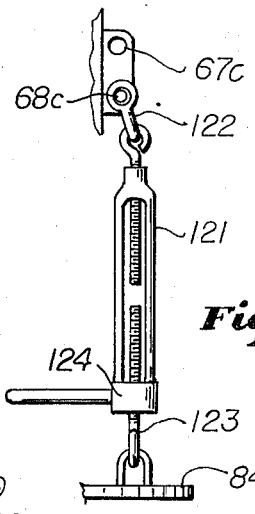
FIG. 8 is an elevational view of a turnbuckle for tightening a halyard.

A still further means of tightening the halyard is shown in FIG. 8. A turnbuckle 121 may be employed having conventional right and left screws. The eye in the upper end of the turnbuckle 121 may be attached by means of clevis 122 or other means to a hole 68*c* in the ear 67*c* of the halyard traveler while the hook 123 on the lower end of the turnbuckle may be attached to shackle 97. A handle 124 extending out from the lower portion of a turnbuckle may be used to loosen and tighten same and preferably the turnbuckle 121 has a commercially available ratchet arrangement incorporated therein and which is not shown in detail in the accompanying drawings but is well understood in the art.

INSTALLATION

To install the apparatus, bearing pad 93 and thrust bearing 94 are installed at the lowermost end of jib stay 19. The drum fairlead 87–88 and guard bracket 90–88 are installed on the lower stay fitting and bolts 89 are tightened. The top spool section 26 is then installed, the two halves 27*a*, 27*b* being fitted over the stay 19 and screws 33 put in place. Thereupon the crown block 57 is installed on the jib stay 19 and fited over the upper end of the topmost section 26 and screws 64 are tightened. The wire halyard 46 is then passed up through one of the bores 39 or 42 and over the pulley 63 and out through the pulley opening 61. The halyard 46 is pulled until the traveler is up inside the bore 39 or 42 of the topmost spool section. If twin jibs are to be used, two halyards are installed. The halyard tail or tails 101 is attached to the ear 67 of the traveler or travelers. An eye 47 is made in the opposite end of the halyard or halyards 64 at the proper length to accommodate the length of the luff of the jib sail 51. The required number of additional spool sections is added, the splices between sections being performed as in FIG. 2 and has heretofore been explained. The lowermost spool section 82 has the drum halves 84 attached to the spool 82 by means of screws 83 so that the furling drum 81 parts in halves with, and on the same plane as, the spool 26. When the lowermost spool parts the furling drum also parts. The drum and lower spool section 26 fit together over the jib stay 19 and are held together by screws 33 in the same manner as the upper spool sections.

It is now possible to install the sail 18. An eye in the head of the sail is attached to the eye in the end of the halyard 47 by means of a clevis 48. The three topmost slug slides 52 located near the head of the sail are inserted through the window 56 in one of the slots 41 of the lowermost section 23. By pulling on the halyard tail 101 the sail is raised. Each enlargement 53 of slug slide 52 is inserted through the window 56 as the sail is being raised. When the sail has been raised the clevis 96 is used to attach the tack 55 of the sail to the shackle 97.

After the sail 18 has been fully installed, any of the tigthening means shown in FIGS. 1, 8, 9 and 10 may be used to tighten the halyard 46. After the halyard is fully tightened, one of the various means such as the chain 106, or clamp 119 is used to secure the ear 67 in place relative to the uppermost flange 84 of the furling drum.

If twin jibs 18 are to be used, the operation heretofore described is repeated, except that the second halyard is installed at the outset together with the first halyard. Two clamps 119 for two halyards may prove impractical. In such case, securing means such as chain 106 may be used for securing the first halyard and clamp 119 for the second.

FURLING

Where a single jib 18 is used, after the halyard has been tightened and secured, as heretofore explained, the line 101 is removed and withdrawn from the holes 99 in the flanges of the furling drum 81 so that the drum may be turned easily. The jib 18 is furled initially by turning the spools 26 annd drum 81 by hand. The furling line 86 is installed on the drum 81 and secured thereto, the line leading to the cockpit. Subsequent furling is accomplished by pulling line 86. By pulling on line 86, the drum 81 and the spool sections 26 which are secured thereto are rotated and this causes the sail 18 to be wrapped around the spool sections 26 either wholly or partially depending on sailing conditions.

Unfurling is accomplished by loosening the furling line 86 and pulling the sheet (not shown) fixed to the aft corner of the jib 18.

What is claimed is:

1. A roller furling assembly for installation on a stay comprising a plurality of spool half-sections shaped to fit around and rotate relative to said stay, first means for joining pairs of said half sections together, second means for joining said pairs of sections end-to-end for rotation together, each said half section having at least one longitudinal bore having a slot extending out to the exterior of said half section, a crown block fixed to the upper end of the uppermost pair of half sections and rotatable about said stay therewith, at least one sheave in said crown block, a furling drum fixed to and rotatable about said stay with the lowermost pair of half sections, a sail, third means on an edge of said sail fitting into a first of said slots and into a first of said bores, a furling line around said drum to rotate said drum around said stay and thereby to rotate said spool half-sections to furl said sail, a halyard fixed to the head of said sail extending up and over said sheave and down a second of said bores, a traveller fixed to the end of said halyard remote from said sail and partially disposed in said second bore, said traveller having an ear extending outside of said second slot, fourth means connected to said ear for tightening said halyard and fifth means for securing said ear in place relative to said assembly to maintain said halyard tight.

2. An assembly according to claim 1 in which said second means comprises a first extension of a first half section of a first pair of half-sections, a second extension of a second half section of a second pair of half sections, said extensions overlapping so that the external configuration of said two pairs is substantially full and continuous and fastening means extending transversely through said first and second half sections to splice said pairs together.

3. An assembly according to claim 1 in which said third means comprises a plurality of slug slides each having an enlarged portion substantially complementary to said first bore, means extending out through said first slot and connecting means connecting said last named means to the adjacent edge of said sail.

4. An assembly according to claim 1 in which said traveller comprises a compression sleeve fitting around and fixed to said end of said halyard.

5. An assembly according to claim 1 in which said traveller ear is apertured and said fourth means comprises a line through an aperture in said ear and thence through holes in said drum and a second sheave fixed relative to said assembly, said line passing through said second sheave, whereby on pulling said line said halyard is tightened.

6. An assembly according to claim 1 in which said traveller ear is apertured and said fourth means comprises a second sheave attached to said ear through said aperture, a line fixed to said drum extending around said second sheave and thence through holes in said drum and a third sheave fixed relative to said assembly, said line passing through said third sheave, whereby on pulling said line said halyard is tightened.

7. An assembly according to claim 1 in which said fourth means comprises a block and tackle interconnecting said ear and said drum.

8. An assembly according to claim 1 in which said fourth means comprises a turnbuckle interconnecting said ear and said drum.

9. An assembly according to claim 1 in which said fifth means comprises a chain interconnecting said ear and said drum.

10. An assembly according to claim 1 in which said fifth means comprises a clamp fixed around a pair of said spool half-sections and bearing against the upper edge of said ear.

11. An assembly according to claim 1 for use with two sails in which each said half section is formed with two longitudinal bores each having a slot extending out to the exterior of said half section and said crown block is provided with a pair of sheaves and which further comprises a second sail having sixth means on an dge of said sail fitting into another of said slots and into another of said bores, a second halyard fixed to the upper edge of said second sail extending up over the second sheave in said crown block and down another of said bores, a second traveller fixed to said second halyard and having a second ear extending out one of said slots, seventh means connected to said second ear for tightening said second halyard and eighth means for securing said second ear in place relative to said assembly to maintain said second halyard tight.

* * * * *